US010750272B2

(12) United States Patent
Roed et al.

(10) Patent No.: US 10,750,272 B2
(45) Date of Patent: Aug. 18, 2020

(54) HEARING DEVICE WITH FLAT FLEXIBLE ELECTRIC CONNECTION

(71) Applicant: Sennheiser Communications A/S, Ballerup (DK)

(72) Inventors: Henrik Roed, Ballerup (DK); Torben Kristensen, Ballerup (DK); Brian Spidsbjerg, Ballerup (DK); Arne Lindbjerg Pedersen, Virum (DK); Martin Feilberg Hansen, Ballerup (DK); Peter Bauerlund, Ballerup (DK)

(73) Assignee: SENNHEISER COMMUNICATIONS A/S, Ballerup (DK)

( * ) Notice: Subject to any disclaimer, the term of this patent is extended or adjusted under 35 U.S.C. 154(b) by 107 days.

(21) Appl. No.: 15/725,507

(22) Filed: Oct. 5, 2017

(65) Prior Publication Data

US 2018/0109868 A1 Apr. 19, 2018

(30) Foreign Application Priority Data

Oct. 14, 2016 (EP) ..... 16193875

(51) Int. Cl.

| | |
|---|---|
| ***H04R 1/10*** | (2006.01) |
| ***H04R 1/08*** | (2006.01) |
| *H04R 1/06* | (2006.01) |

(52) U.S. Cl.

CPC ..... *H04R 1/1066* (2013.01); *H04R 1/083* (2013.01); *H04R 1/06* (2013.01); *H04R 1/1058* (2013.01); *H04R 2201/107* (2013.01); *H04R 2420/09* (2013.01)

(58) Field of Classification Search

CPC ..... H04R 1/1066; H04R 1/083; H04R 1/06; H04R 1/1058; H04R 2201/107; H04R 2420/09

USPC .... 381/74, 366, 361, 395, 150, 384; 439/23, 439/22, 67; 174/254, 250

See application file for complete search history.

(56) References Cited

U.S. PATENT DOCUMENTS

| | | | | |
|---|---|---|---|---|
| 8,358,395 | B1 * | 1/2013 | Szeremeta | G02F 1/13452 349/150 |
| 2004/0052364 | A1 * | 3/2004 | Bodley | H04M 1/05 379/430 |
| 2005/0012199 | A1 * | 1/2005 | Rosenau | G02B 6/4201 257/696 |

(Continued)

FOREIGN PATENT DOCUMENTS

| | | | |
|---|---|---|---|
| CN | 201349227 | Y | 11/2009 |
| JP | 2 309 618 | A1 | 4/2011 |
| JP | 2011-091438 | A | 5/2011 |

*Primary Examiner* — Vivian C Chin
*Assistant Examiner* — Con P Tran
(74) *Attorney, Agent, or Firm* — Birch, Stewart, Kolasch & Birch, LLP

(57) ABSTRACT

The invention relates to a hearing device that comprises a flexible electric connection between device components that are pivotably connected to each other. The electric connection comprises an originally flat flexible circuit comprising one or more electric conductors embedded in a flexible substrate. The flexible circuit comprises a centre portion that is curved in its original, flat state and that in its mounted stage is bent to form a turn such that two curved sections of the curved centre portion emerge that are arranged opposite to each other in two spaced apart planes that essentially are parallel to each other.

20 Claims, 5 Drawing Sheets

(56) References Cited

U.S. PATENT DOCUMENTS

2011/0086677 A1* 4/2011 Jensen ..... H02J 7/0044
455/569.1
2011/0206218 A1 8/2011 Birch

* cited by examiner

HEARING DEVICE WITH FLAT FLEXIBLE ELECTRIC CONNECTION

TECHNICAL FIELD

The invention relates to a hearing device comprising a flat flexible electric connection between device components that are pivotably connected to each other.

BACKGROUND

It is well known in the art to use a flexible electric connector for connecting a microphone within a pivotable boom arm of a hearing device with a processor of the hearing device, which is typically arranged within an ear cup of the hearing device.

Such a flexible electric connector is usually fixated at two parts of the hearing aid, which are arranged to be pivoted with respect to each other. The flexible electric connector allows the pivoting due to a flexible section, which is wound around a respective axis of rotation in a coil-shaped manner, forming a so-called "coil flex", or in a U-shaped manner, forming a so-called "U flex".

For preventing a mechanical damage of the flat flexible electric connector due to the pivoting, the pivotable boom arm is usually limited in its rotational motion by a mechanical stop, allowing a rotation between a first and a second position.

EP 2 309 618 A1 describes a wireless headset with a flexprint element enclosed in between a shell of an ear cup and a cam follower disc of a boom arm. Electric leads are provided as lanes on a flexible sheet material of the flexprint element, wherein the lanes are usually generated in electrochemical processing.

SUMMARY

It is an object of the present invention to provide an improved hearing device with pivotable members.

The hearing device according to the invention comprises a flat flexible electric connection between device components that are pivotably connected to each other. The electric connection comprises a flexible circuit that is flat in its originally state. The flexible circuit comprises one or more electric conductors embedded in a flexible substrate. The flexible circuit comprises a centre portion that is curved in its original, flat state and that in its mounted stage is bent to form a turn such that two curved sections of the curved centre portion emerge that are arranged opposite to each other in two spaced apart planes that essentially are parallel to each other.

The flat flexible electric connection advantageously allows a pivoting between device components of the hearing device by bending the centre portion of the flexible electric connection such that the turn formed by the centre portion is moved along the centre portion while pivoting the respective device components into a direction of rotation.

Using a turn between the two curved sections leads to an advantageously small amount of material needed for the flexible electric connection. Furthermore the flat flexible electric connection allows a compact rotation and therefore has a compact structure and can support a robustness of the circuit of the hearing device. A bending diameter of the turn should be kept within a bending diameter fulfilling the need of the compact rotation. It is clear that if increasing the bending diameter the compact rotation might not be compact enough. Therefore the choose of the bending diameter should be a trade-off of how compact the rotation should be, the bending strength of the flat flexible circuit and a dynamic stress which is applied to the flat flexible electric connection during rotation of the device components. It has surprisingly been found that the ideal bending radius for minimizing the dynamic stress and to keep a compact rotation which fits into a hearing device, such as a headset, and without challenging the bending strength of the flat flexible circuit, the bending diameter B should be between 1 mm and 4 mm, in particular between 1.5 mm and 3.5 mm, and such as between 1.5 mm and 2.5 mm. Additionally, it has surprisingly been found that if the bending diameter is between 1.85 mm and 2.5 mm the dynamic stress is eliminated.

The smallest possible bend radius have been found and despite giving the highest stress the connections will not break/failed during rotation. The smallest radius provides the biggest stress and that what's makes it difficult to make the disclosed hearing device compact. If the bending diameter is bigger it's easier to make robust/not break. The reason for why the connections do not break is a combination of the bending diameter, the material of the flex connection and the housing for guiding the flex connection during rotation.

The dynamic stress is a stress which is applied to the flat flexible connection along a transverse direction and a longitudinal direction of the flat flexible connection, and if the bending diameter is not within the ranges mentioned above the flexible connection will start to bend un-controllable and the user will experience that the compact rotation of the flat flexible electric connection is not possible.

The turn formed by the centre portion in its bent state results from a bending into a direction that is essentially perpendicular to the two spaced apart planes of the two curved sections while the turn is wound around a virtual axis that is essentially parallel to said two planes and that is essentially perpendicular to the axis of rotation of the relative movement of the two device components that are pivotably connected to each other.

The device components that are pivotably connected to each other usually comprise an ear cup of the hearing device.

In the following, embodiments of the hearing device with the flat flexible electric connection are described.

In a preferred embodiment of the hearing device respective portions of the device components form a housing that houses the flat flexible circuit. The housing protects the flexible electric connection of the hearing device against environmental influences, such as water or pulling forces. The hearing device of this embodiment is therefore particularly robust.

In a further preferred embodiment, the housing comprises two parts that can rotate with respect to each other around an axis of rotation and wherein the two spaced apart planes essentially extend perpendicular to the axis of rotation.

In an embodiment of the hearing device, the housing forms a hinge. Preferably, the hinge is formed by the two parts of the housing, which surround the device components that are pivotably connected to each other.

In a preferred embodiment, the flat flexible circuit comprises at least one radially extending portion that extends from the curved centre portion in a radial direction. The radial direction is essentially perpendicular to the axis of rotation. The radially extending portion may provide a connection between the centre portion of the flexible circuit and a connector interface, such as zif (zero insertion force) connectors, which connect the flat flexible circuit with further electronics of the hearing device. Preferably, the radially extending portion is used to fixate the flat flexible circuit at a respective device component, e.g. via an adhesive bond or a form fit.

In a further embodiment, the flat flexible circuit comprises a second curved portion that connects to the centre portion and that is essentially coplanar and concentric with one of the two sections of the curved centre portion. Preferably, the second curved portion is connected with the curved centre portion via the radially extending portion. The second curved portion is preferably fixed at a respective device component. The second curved portion may comprise a connector interface, such as a zif connector. Preferably, the second curved portion has a larger diameter than the curved centre portion. In such an embodiment, the flat flexible electric connector can be advantageously produced from a single sheet of the flexible substrate. For example, the second curved portion may partly surround the curved centre portion.

In a preferred embodiment, the hearing device is a headset comprising a pivotable boom arm. Preferably, the flexible circuit is arranged within a hinge connecting the boom arm to another component of the headset.

In a further embodiment, the hearing device comprises a pivotable ear pad. Preferably, the flexible circuit of this embodiment is arranged within a hinge connecting the pivotable ear pad with a headband of the hearing device.

In a preferred embodiment, the housing encloses an annular space that encloses the curved centre portion. The annular space is preferably arranged concentric with respect to the axis of rotation. Preferably, the annular space is formed by a recess in a first housing member that is rotatably connected to a second housing member.

In an embodiment of the hearing device, the boom arm extends from the second housing member so as rotate together with the second housing member with respect to the first housing member, said housing members forming the hinge for the boom arm. In this embodiment, the flexible electric connection of the hearing device allows the boom arm to rotate with respect to the first housing member, which is typically fixed to a headband of the hearing device. In this embodiment, there may be at least one mechanical stop arranged within the first or second housing member. The mechanical stop helps a user of the hearing device to recognize a position of maximal angle of rotation of the second housing with respect to the first housing. Too large angles of rotation can damage the flexible electric connector and thereby cause defects of the hearing device. Preferably, the first or second housing member comprises a first and a second mechanical stop, to allow the user of the hearing device to rotate the boom arm between a first and a second position. The first and second positions are chosen such that the tension applied on the centre portion while rotating the respective device component does not exceed a tension threshold value.

In an embodiment of the hearing device, the turn resulting from bending the centre portion of the flexible circuit has a bending diameter between 1 mm and 4 mm, in particular between 1.5 mm and 3.5 mm, such as between 1.5 mm and 2.5 mm and preferably between 1.85 mm and 2.5 mm. These bending diameter ranges allow a compact structure of the flexible electric connection. Preferably, these bending diameter ranges further allow a level of tension applied to the centre portion that does not exceed the tension threshold value for the used flexible substrate.

In a further embodiment of the hearing device, the curved centre portion has an outside diameter smaller than 20 mm.

In a further embodiment of the hearing device, the flat circuit comprises at least one flat conductor made from copper that is arranged between at least two layers of a plastic material, in particular between two layers made from polyimide. The two layers of a plastic material are preferably attached to the at least one flat conductor made from copper via two respective layers of an adhesive. The flat conductor of this embodiment is advantageously flexible for allowing the centre portion to provide the turn.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

The detailed description set forth below in connection with the appended drawings is intended as a description of various configurations. The detailed description includes specific details for the purpose of providing a thorough understanding of various concepts. However, it will be apparent to those skilled in the art that these concepts may be practised without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Figure 1B:
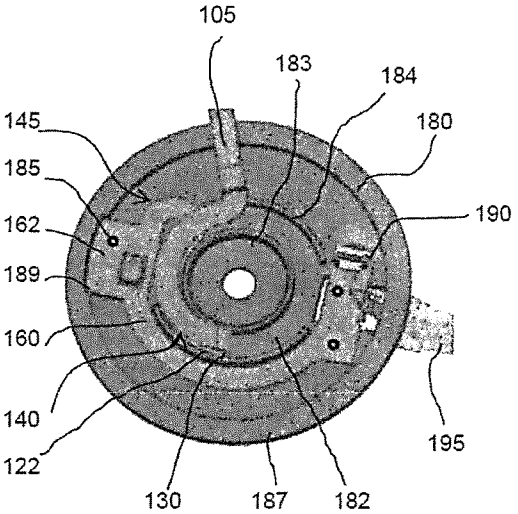
FIGS. 1*a*, 1*b* illustrate an embodiment of an unfolded flat flexible electric connection according to the invention (FIG. 1*a*) and of the respective folded electric connection arranged within a second housing member (FIG. 1*b*)
Figure 1A:
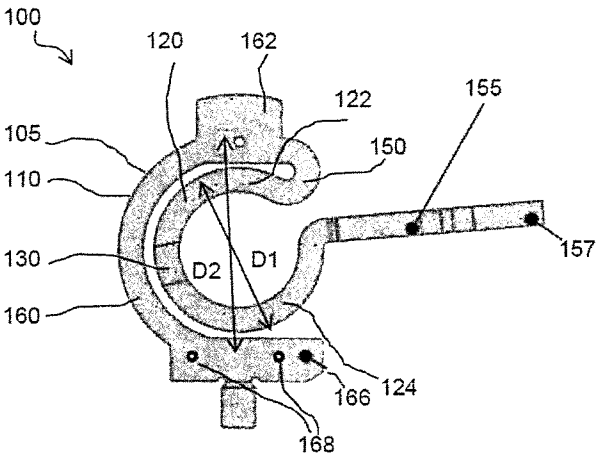

Now referring to FIGS. 1*a* and 1*b*, which illustrate an embodiment of an unfolded flat flexible electric connection 100 according to the invention (FIG. 1*a*) as well as the respective folded electric connection 100 arranged within a second housing member 180 (FIG. 1*b*).

The unfolded flat flexible electric connection 100 shown in FIG. 1*a* comprises a flat flexible circuit 105 comprising one or more electric conductors (not shown for reasons of clarity) embedded in a flexible substrate 110.

The flat flexible circuit 105 comprises a centre portion 120 that is curved in its original, flat state (as shown in FIG. 1*a*) and that in its mounted stage (as shown in FIG. 1*b*) is bent to form a turn 130 such that two curved sections 122, 124 of the curved centre portion 120 emerge that are arranged opposite to each other in two spaced apart planes 140, 145 (as shown in FIG. 1*b*) that essentially are parallel to each other.

Furthermore, the flat flexible circuit 105 comprises a first and a second radially extending portion 150, 155 that extend from the curved centre portion 120 in a radial direction. The first radially extending portion 150 connects the curved centre portion 120 with a second curved portion 160 that is coplanar and concentric with the first curved section 122 of the curved centre portion 120. The second radially extending portion 155 forms a tail end 157 of the flexible electric connection 100 which provides a zif connector (not shown) adapted to form a connection with further electronics of the respective hearing device. The curved centre portion 120 has an outside diameter D1 of about 19.7 mm, i.e. smaller than 20 mm.

The second curved portion 160 has a larger diameter D2 than the curved centre portion 120. Furthermore, the second curved portion 160 comprises two segments 162, 166 that are arranged to be attached to a housing member of the respective hearing device. In the embodiment illustrated in FIG. 1*a*, these segments 162, 166 comprise holes 168 that are arranged to match respective attachment pins of the second housing member 180 of the hearing device (as shown in FIG. 1*b*). In embodiments not shown, at least one segment of the second curved portion is attached to a housing member of the respective hearing device by an adhesive binding or by a further form fit. In an alternative embodiment, at least one segment of the curved centre portion is attached to a housing member of the respective hearing device. An electric contact between the flat flexible electric connection 100 and further electronics arranged at the second housing member 180 is provided by a further zif connector (not shown) of the second curved portion 160.

In alternative embodiments, another electric connector, such as a plug, a socket connector or a binding post, is used instead of a respective zif connector at the second curved portion and/or at the second radially extending portion.

The turn 130 of the curved centre portion 120 has preferably a bending diameter B between 1 mm and 4 mm, in particular between 1.5 mm and 3.5 mm, such as between 1.5 mm and 2.5 mm, and preferably between 1.85 mm and 2.5 mm.

The embodiment of the flat flexible electric connection 100 provides the flat flexible circuit 105 that comprises a flat conductor made from copper that is arranged between two layers of polyimide. The two layers of polyimide are attached to the conductor made from copper by two respective layers of an adhesive.

The present structure of the flat flexible circuit 105 allows the centre portion 120 of the flexible electric connection 100 to be bended at the turn 130. The turn 130 can be present at any position of the centre portion 120 of the flat flexible electric connection 100, depending on a respective angle of rotation of the respective device components of the hearing device with respect to each other (as discussed in the course of FIG. 2). Therefore, the centre portion 120 is provided such that it is configured to overcome a dynamic stress during a rotation of the device components with respect to each other.

FIG. 1*b* shows the flat flexible circuit 105 of the flat flexible electric connection 100 in its mounted state, wherein it is bended to form the turn 130 and wherein the second curved portion 160 is attached to the second housing member 180.

The second curved portion is attached via attachment pins 185 of the second housing member 180 and via a form fit of the first segment 162 with respect to a frame recess 189 of a ring shaped frame 187 of the second housing member 180. It is furthermore illustrated in FIG. 1*b* that the zif connector of the second curved portion 160 is connected to the second housing member 180 via a boom arm interface 190, which electrically connects the flat flexible electric connection 100 with a boom arm 195 of the hearing device. The boom arm 195 is physically attached to the second housing member 180 and thereby extends from the second housing member 180 so as to rotate together with the second housing member 180.

In embodiments not shown, the device components that are electrically connected via the flat flexible connection do not comprise a boom arm. In particular, in an embodiment of the invention one rotatable device component is a rotatable ear cup. Such a rotatable ear cup can be advantageously adapted to an ear shape of the outer ear of the user of the hearing device. An ear pad is fixed to the ear cup.

The second housing member 180 furthermore comprises an annular space 182 formed by two respective concentric annular elements 183, 184. Thereby the annular space 182 is arranged to enclose the curved section 122 that faces the second housing member 180. While rotating the second housing member 180 with respect to the axis of rotation (which is perpendicular to the drawing plane), the turn 130 will move along the annular space 182 and thus change a respective annular length of the two curved sections 122, 124 of the curved centre portion 120. The two spaced apart planes 140, 145 of the two curved sections 122, 124 are essentially parallel to the drawing plane of FIG. 1*b*.

Figure 2:
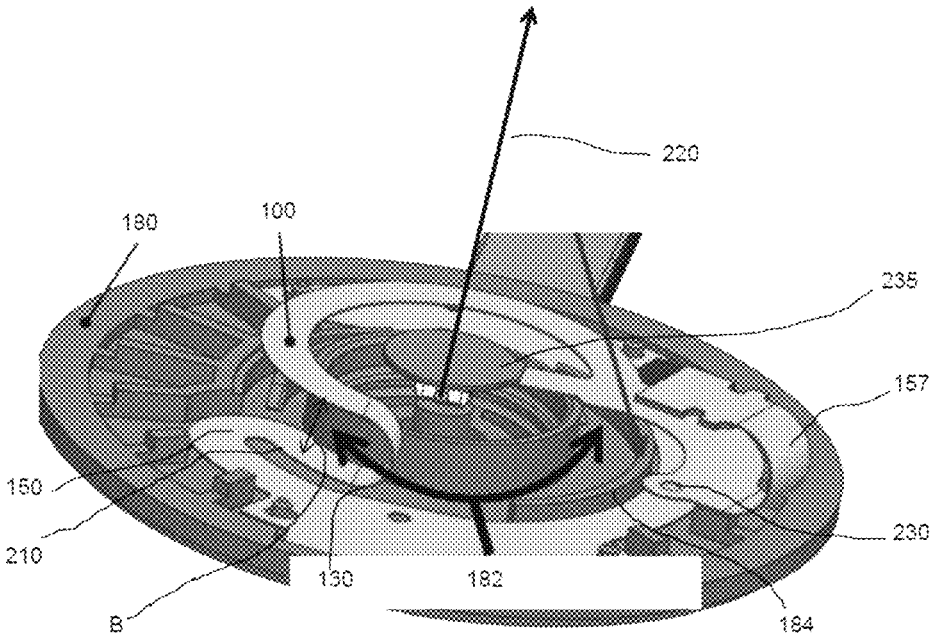
FIG. 2 illustrates a upper side view of the embodiment of the folded electric connection arranged within the second housing member.

FIG. 2 illustrates an upper side view of the embodiment of the folded electric connection 100 arranged within the second housing member 180.

The embodiment shown in FIG. 2 is identical with the embodiment shown in FIG. 1*b*, but in addition, the second housing member 180 with its attachment to the flat flexible electric connection 100 as well as the tail end 157 of the flat flexible electric connection 100 are shown in more detail.

The outer annular element 184 forms a gap 210 for the first radially extending portion 150, so that the turn 130 formed by the curved centre portion 120 can move along the annular space 182, while rotating the second housing member 180. Rotating the second housing member 180 with respect to a further device component, i.e. to a first housing member, means that the tail end 157 of the flat flexible electric connection 100 rests in its position, since it is attached to the first housing member (as shown in FIG. 3) while the second curved portion 160 rotates along the axis of rotation 220.

The tail end 157 comprises a further hole 230 which is arranged according to a respective attachment pin of the first housing member of the hearing device. In further embodiments, the tail end might also be attached to the first housing member by an adhesive binding or by a further form fit. The tail end 157 further comprises a central element 235 within the axis of rotation 220. The central element 235 is arranged to allow a fixation of the tail end 157 at the first housing member.

In other embodiments, the tail end is further adapted according to a structure of the first housing member and respectively bended and formed. In such embodiments, the tail end does not comprise the central element and/or a further hole, but other attachment elements in order to fixate the tail end and/or a curved section of the flat flexible electric connection at the first housing member, while the second curved portion and/or a respective curved section is fixated at the second housing member.

Figure 3:
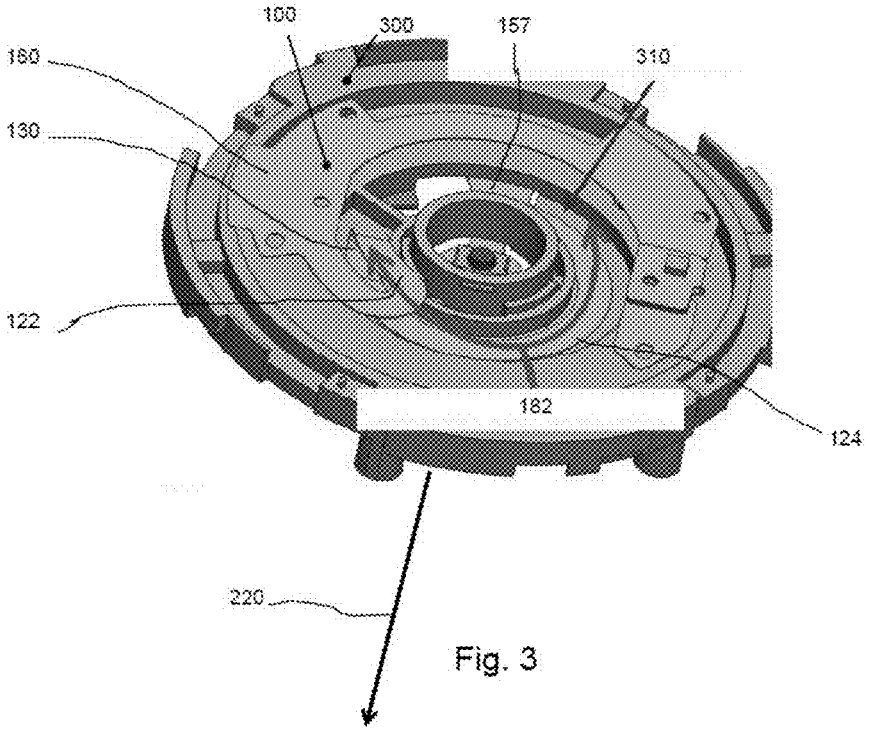
FIG. 3 illustrates a bottom side view of the embodiment of the folded electric connection arranged within the first housing member.

FIG. 3 illustrates a bottom side view of the embodiment of the folded electric connection 100 arranged within the first housing member 300.

The first housing member 300 is formed to be rotatable arranged at the second housing member 180 shown in FIG. 2 with respect to the axis of rotation 220. For allowing such a rotation, the first housing member 300 provides a recess 310 that forms the annular space 182. The curved centre portion 120 extends trough the recess 310 at the position of the turn 130 and thereby extends between the two curved sections 122, 124, i.e. between the second curved portion 160 and the tail end 157.

By rotating the second housing member 180 with respect to first housing member 300, the turn 130 moves along the recess 310, since the second curved portion 160 is attached to the second housing member and the tail end 157 is attached to the first housing member 300.

A further housing structure shown in FIG. 3 is prescribed by further characteristics of the respective hearing device so that the invention is not restricted to this further housing structure.

Figure 4:
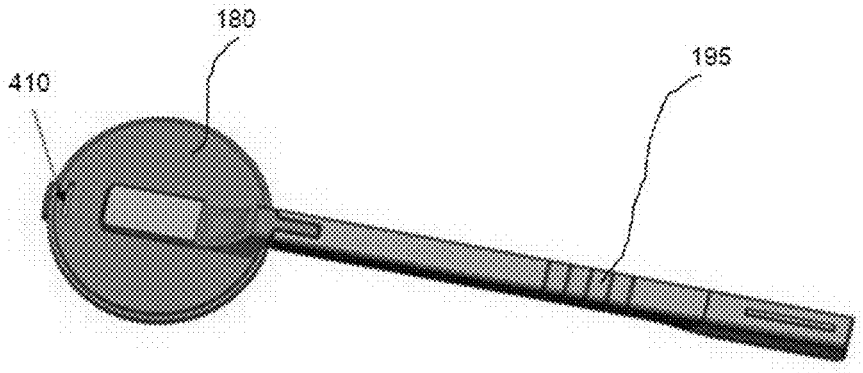
FIG. 4 illustrates an embodiment of the second housing member with an attached boom arm according to the invention.

FIG. 4 illustrates an embodiment of the second housing member 180 with an attached boom arm 195 according to the invention.

The shown embodiment is identical to the second housing member 180 shown in FIG. 1*b*. However, FIG. 4 shows the opposite side of the second housing member 180 with the boom arm 195 attached to the housing.

In contrast to FIG. 1*b*, it is further shown that the second housing member 180 comprises a microphone inlet 410, which allows a sound signal to pass through the second housing member 180 and to be received by a microphone unit arranged at the flat flexible circuit 105. Therefore, the flat flexible circuit 105 of this embodiment is configured to provide boom arm signals as well as further microphone signals received by the microphone unit. Arranging the microphone unit at the flexible circuit advantageously allows the microphone unit to be behind the microphone inlet 410 in every rotational position of the boom arm 195. The directionality performance of the microphone arrangement is the same no matter the position of the boom arm.

Figure 5B:
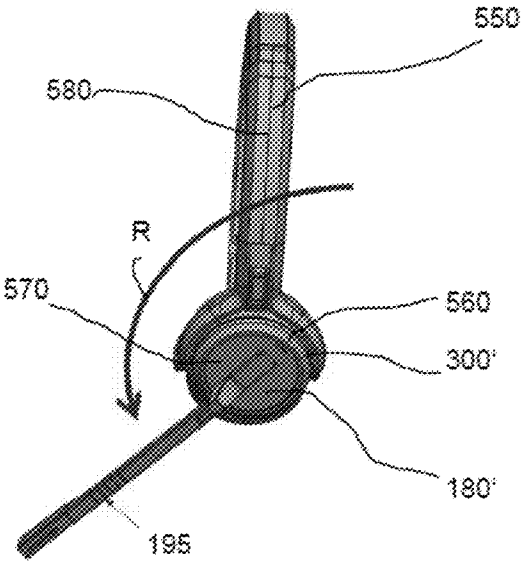
FIGS. 5*a*, 5*b* illustrate an embodiment of first and second housing connected to each other (FIG. 5*a*) and of a hearing device comprising the flat flexible electric connection as shown in FIG. 1*b;*
Figure 5A:
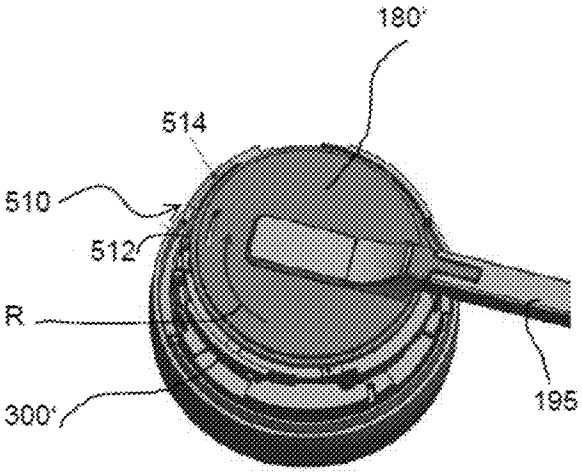

FIGS. 5*a* and 5*b* illustrate a combined state, wherein the first and second housing members 180', 300' are pivotably connected to each other (FIG. 5*a*) and a hearing device 550 comprising the flat flexible electric connection 100 according to FIGS. 1*a* and 1*b* (FIG. 5*b*).

The first and second housing members 180', 300' are similar to those shown in FIG. 2 and FIG. 3. But in contrast to the previously shown housing members, the embodiment of the first and second housing members 180', 300' shown in FIG. 5*a* comprises an additional boom arm stop interface 510.

The boom arm stop interface 510 comprises a mechanical stop 512 arranged at the second housing member 180' and an extending part 514 arranged at the first housing member 300'. The mechanical stop 512 and the extending part 514 are arranged such that the mechanical stop 512 stops a rotation of the first housing member 300' with respect to the second housing member 180' by stopping the extending part 514 and thereby preventing a further rotation of the first housing member 300'. Thus, the boom arm stop interface 510 allows a rotation of the second housing member 180' between two predefined positions of the boom arm 195.

FIG. 5*b* shows the hearing device 550 comprising the flat flexible electric connection 100 and the combined state of the first and second housing members 180' and 300' as shown in FIG. 5*a*.

In contrast to the embodiment shown in FIG. 5*a*, an additional housing 560 surrounds the first and second housing members 180', 300' and thereby fixates both device components with respect to the axis of rotation (that is nearly perpendicular to the drawing plane) of the boom arm 195. As a consequence, the second housing member 180' forms a hinge of the boom arm 195.

The position of the boom arm 195 can be adapted with respect to the two predefined positions that limit the rotation of the boom arm 195 in view of the boom arm stop interface 510.

The rotation R of the boom arm, advantageously allowed by the flat flexible electric connection according to the invention, enables the user of the hearing device 550 to wear the boom arm 195 with its microphone at the left or right ear. Furthermore, the boom arm position can be adapted to a respective position of the user's mouth.

In the present embodiment, the hearing device 550 is a headset comprising a pivotable boom arm 195. The flexible electric connection 100 provided inside the housing 560 and housing members 180', 300' connects the boom arm 195 to another electric component of the headset, which is arranged within the ear cup 570 and/or within the headband 580 of the hearing device 550. In other embodiments the hearing device is a headphone, a hearing aid, or any other audio device comprising a pivotable boom arm and/or a rotatable ear pad.

Figure 6:
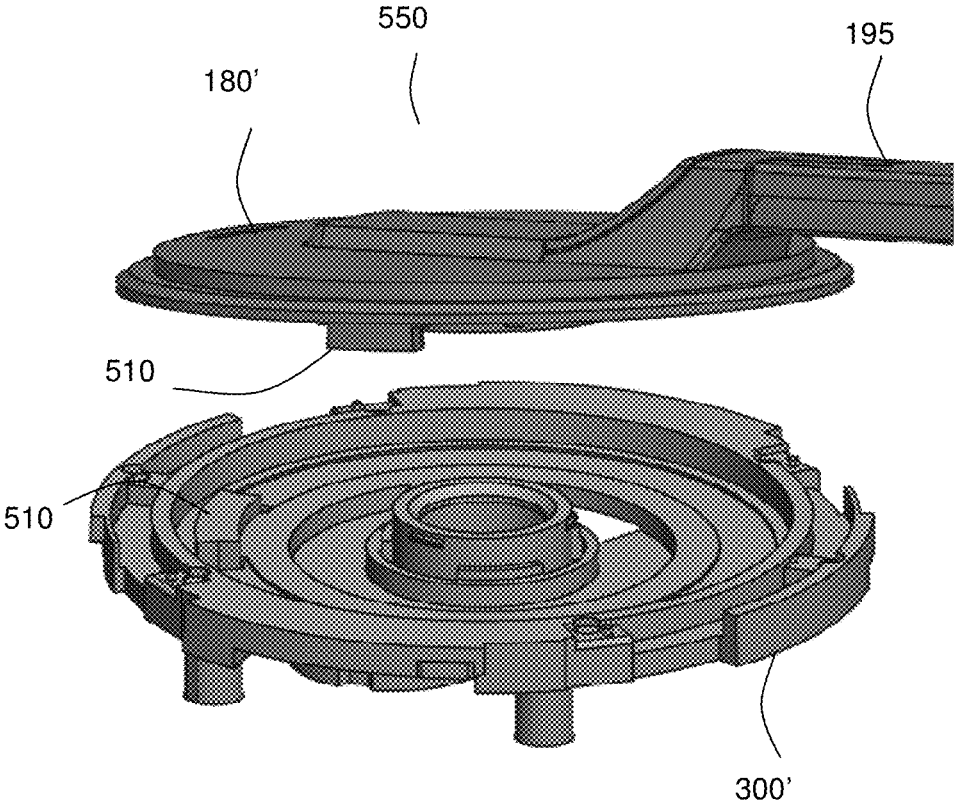
FIG. 6 illustrates an embodiment according to the invention with a mechanical stop.

FIG. 6 shows the hearing device 550 comprising the combined state of the first and second housing members 180' and 300'. The position of the boom arm 195 can be adapted with respect to the two predefined positions that limit the rotation of the boom arm 195 in view of the boom arm stop interface 510.

It is intended that the structural features of the devices described above, either in the detailed description and/or in the claims, may be combined with steps of the method, when appropriately substituted by a corresponding process.

As used, the singular forms "a," "an", and "the" are intended to include the plural forms as well (i.e. to have the meaning "at least one"), unless expressly stated otherwise. It will be further understood that the terms "includes", "comprises", "including", and/or "comprising", when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more". Unless specifically stated otherwise, the term "some" refers to one or more.

LIST OF REFERENCE SIGNS

100 Flat flexible electric connection
105 Flat flexible circuit
110 Flexible substrate
120 Centre portion
122, 124 Curved section
130 Turn
140, 145 Spaced apart plane
150 First radially extending portion
155 Second radially extending portion
157 Tail end
160 Second curved section
162 First segment
166 Second segment
168 Holes
180, 180' Second housing member
182 Annular space
183, 184 Concentric annular element
185 Attachment pins
187 Ring shaped frame
189 Frame recess segment
190 Boom arm interface
195 Boom arm
210 Gap
220 Axis of rotation
230 Further hole
235 Central element
300, 300' First housing member
310 Recess
410 Microphone inlet
510 Boom arm stop interface
512 Mechanical stop
514 Extending part
550 Hearing device
560 Additional housing
570 Ear cup
580 Headband
D1 Outside diameter of centre portion
D2 Diameter of second curved portion
B Bending diameter
R Rotation

The invention claimed is:

1. Hearing device comprising a flat flexible electric connection between device components that are pivotably connected to each other, the electric connection comprising an originally flat flexible circuit comprising one or more electric conductors embedded in a flexible substrate, said originally flat flexible circuit comprising a first curved portion that is shaped as a curved strip in planar view in an original, flat state of the originally flat flexible circuit, said originally flat flexible circuit being adapted from the original, flat state to a mounted state by bending the first curved portion at a point of curvature in the curved strip shape to form a turn, said bending causing that two curved sections of the first curved portion to emerge in two spaced apart planes that are parallel to each other, wherein a change in an angle of rotation between the device components changes a position of the turn along said first curved portion thereby causing a simultaneous increase and decrease in respective lengths of the two curved sections.

2. Hearing device according to claim 1, wherein respective portions of the device components form a housing that houses the originally flat flexible circuit.

3. Hearing device according to claim 2, wherein the housing comprises two parts that can rotate with respect to each other around an axis of rotation and wherein the two spaced apart planes extend perpendicular to the axis of rotation.

4. Hearing device according to claim 3, wherein the housing forms a hinge.

5. Hearing device according to claim 3, wherein the originally flat flexible circuit comprises at least one radially extending portion that extends from the first curved portion in a radial direction.

6. Hearing device according to claim 2, wherein the housing forms a hinge.

7. Hearing device according to claim 6, wherein the originally flat flexible circuit comprises at least one radially extending portion that extends from the first curved portion in a radial direction.

8. Hearing device according to claim 2, wherein the housing encloses an annular space that encloses the first curved portion.

9. Hearing device according to claim 8, wherein the annular space is formed by a recess in a first housing member that is rotatably connected to a second housing member.

10. Hearing device according to claim 2, wherein the originally flat flexible circuit comprises at least one radially extending portion that extends from the first curved portion in a radial direction.

11. Hearing device according to claim 2, wherein the originally flat flexible circuit comprises a second curved portion that connects to the first curved portion and that is coplanar and concentric with one of the two sections of the first curved portion.

12. Hearing device according to claim 1, wherein the original flat flexible circuit comprises at least one radially extending portion that extends from the first curved portion in a radial direction.

13. Hearing device according to claim 1, wherein the original flat flexible circuit comprises a second curved portion that connects to the first curved portion and that is coplanar and concentric with one of the two sections of the first curved portion.

14. Hearing device according to claim 13, wherein the second curved portion has a larger diameter than the first curved portion.

15. Hearing device according to claim 1, wherein the device is a headset comprising a pivotable boom arm.

16. Hearing device according to claim 15, wherein the originally flat flexible circuit is arranged within a hinge connecting the boom arm to another component of the headset.

17. Hearing device according to claim 16, wherein a housing of the device comprises two parts, a first and a second housing member, and the boom arm extends from the second housing member so as rotate together with the second housing member with respect to the first housing member, said housing members forming the hinge for the boom arm.

18. Hearing device according to claim 1, wherein the turn has a bending diameter between 1.5 mm and 3.5 mm.

19. Hearing device according to claim 1, wherein the first curved portion has an outside diameter smaller than 20 mm.

20. Hearing device according to claim 1, wherein the originally flat flexible circuit comprises at least one flat conductor made from copper that is arranged between at least two layers of a plastic material, in particular between two layers made from polyimide.

* * * * *